US006000967A

United States Patent [19]

Norizuki et al.

[11] Patent Number: 6,000,967

[45] Date of Patent: Dec. 14, 1999

[54] CONNECTOR

[75] Inventors: Teruhisa Norizuki; Yuji Hatagishi; Takayoshi Endo, all of Shizuoka, Japan

[73] Assignee: Yazaki Corporation, Tokyo, Japan

[21] Appl. No.: 08/998,024

[22] Filed: Dec. 24, 1997

[30] Foreign Application Priority Data

Dec. 26, 1996 [JP] Japan ..... 8-348257

[51] Int. Cl.[6] ..... H01R 13/40

[52] U.S. Cl. ..... 439/596; 439/752

[58] Field of Search ..... 439/752, 595, 439/596

[56] References Cited

U.S. PATENT DOCUMENTS

| | | | |
|---|---|---|---|
| 5,460,550 | 10/1995 | Okayasu et al. | 439/752 |
| 5,697,819 | 12/1997 | Hatagishi | 439/752 |
| 5,769,670 | 6/1998 | Abe | 439/752 |

FOREIGN PATENT DOCUMENTS

| | | |
|---|---|---|
| 4-136869 | 12/1992 | Japan . |
| 5-226025 | 9/1993 | Japan . |

*Primary Examiner*—Gary F. Paumen
*Attorney, Agent, or Firm*—Morgan, Lewis & Bockius LLP

[57] ABSTRACT

There is disclosed a connector which can be used with either of crimp-type terminals and press-connecting terminals, thereby enhancing an operation efficiency, and also reducing the cost. The connector includes a housing having an opening formed at one side of rear half portions of terminal receiving chambers, and wires are inserted respectively into the terminal receiving chambers through the opening, and the housing has a cover for covering the opening. The cover is integrally connected by molding to that portion of the housing, disposed forwardly of the opening, through a hinge so that the cover can be turned between a closed and an open position. The cover and the housing are provided with engagement means by which the cover can be retained relative to the housing in a two-stage manner, that is, in a provisionally-retained condition in which the cover is provisionally retained relative to the housing to provisionally retain terminals received respectively in the terminal receiving chambers, and a completely-retained condition in which the cover is completely retained relative to the housing to completely retain the terminals and also to close the opening.

2 Claims, 5 Drawing Sheets

CONNECTOR

BACKGROUND OF THE INVENTION

1. Field of the Invention

This invention relates to a connector for use with either of press-connecting terminals and crimp-type terminals.

2. Related Art

FIG. 1 shows a connector for press-connecting terminals disclosed in Japanese Utility Model Unexamined Publication No. 4-136869, and a housing 30 of this connector includes terminal receiving chambers 31 which are open as at 30*a* at one side of a rear half portion of the housing 30, upwardly-projecting cover retaining projections 32 formed respectively on upper edges of partition walls, a wall portion 33 extending forwardly from the opening 30*a*, and a cover insertion hole 34. Press-connecting terminals (not shown) are inserted respectively into the terminal receiving chambers 31, and then a front end of a separate cover 35 is inserted into the cover insertion hole 34, and the cover 35 is pushed down, so that the cover retaining projections 32 are fitted respectively in retaining grooves 36 formed in the cover 35.

FIG. 2 shows a connector for crimp-type terminals disclosed in Japanese Patent Unexamined Publication No. 5-226025, and rear ends of a pair of covers 42 are connected by hinges 43 to a rear end of a housing 41, having terminal receiving chambers 40, so that each cover 42 can be opened and closed, and each cover 42 is closed from the rear side of the housing 41 toward the front side thereof.

However, when crimp-type terminals are to be used in the press-connecting terminal connector shown in FIG. 1 the plurality of crimp-type terminals are often inserted into the terminal receiving chambers at different times, depending on the kinds of wires and so on, and in this case there is encountered a problem that the terminals are liable to be withdrawn before the separate cover 35 is attached to the housing 30. On the other hand, in order to prevent the withdrawal of the terminals, if the separate cover 35 is attached to the housing 30 each time the crimp-type terminals are inserted into the corresponding terminal receiving chambers 31, there is encountered a problem that the operation is cumbersome.

When press-connecting terminals are to be used in the crimp-type connector shown in FIG. 2, there is encountered a problem that since the housing 41 has walls 41 formed at its upper and lower sides, a wire can not be press-connected to the press-connecting terminal, mounted in each terminal receiving chamber 40, even when the cover 42 is opened. Even if each wall 44 is removed to open rear half portions of the terminal receiving chambers 40, the cover 42 exists above this opening, and it is difficult to press-connect each wire to the associated terminal.

SUMMARY OF THE INVENTION

It is therefore an object of this invention to provide a connector which can be used with either of crimp-type terminals and press-connecting terminals, thereby enhancing an operation efficiency, and also reducing the cost.

According to a first aspect of the present invention, there is provided a connector comprising a housing having an opening formed at one side of rear half portions of terminal receiving chambers, wires being inserted respectively into the terminal receiving chambers through the opening, and the housing having a cover for covering the opening; wherein the cover is integrally connected by molding to that portion of the housing, disposed forwardly of tho opening, through a hinge so that the cover can be turned between a closed and an open position; and the cover and the housing are provided with engagement means by which the cover can be retained relative to the housing in a two-stage manner, that is, in a provisionally-retained condition in which the cover is provisionally retained relative to the housing to provisionally retain terminals received respectively in the terminal receiving chambers, and a completely-retained condition in which the cover is completely retained relative to the housing to completely retain the terminals and also to close the opening.

In the first aspect of the present invention, when crimp-type terminals each connected to a wire are to be inserted respectively into the terminal receiving chambers, the two-stage retaining operation (that is, the provisionally-retained condition and the completely-retained condition) can be used. When wires are to be press-connected respectively to press-connecting terminals beforehand mounted in the housing, the cover is opened forwardly, and the wires are inserted through the open rear half portions of the terminal receiving chambers, and are press-connected respectively to the terminals, and also the cover can be completely retained directly on the housing.

In the connector of a second aspect of the present invention, the engagement means includes retaining grooves formed in the cover, provisionally-retaining lock portions formed on the housing, and completely-retaining lock portions formed on the housing, and in the provisionally-retained condition in which the provisionally-retaining lock portions are engaged respectively in the retaining grooves, the completely-retaining lock portions function as stoppers for the cover.

In the second aspect of the present invention, in addition to the effects of the first aspect of the present invention, the completely-retaining lock portions limit the movement of the cover in the provisionally-retained condition, thereby enhancing the efficiency of mounting of the crimp-type terminals.

In the connector of a third aspect of the present invention, a connecting piece is formed integrally with the housing and the cover, and integrally connects the housing to the cover inverted into a position disposed forwardly of the opening, and the connecting piece can be cut.

In the third aspect of the present invention, in addition to the effects of the first and second aspect of the present invention, the inverted cover is held on the housing by the connecting piece, and therefore the operation efficiency for the press-connecting terminals is enhanced.

In the connector of a fourth aspect of the present invention, positioning recesses are formed respectively in partition walls for the terminal receiving chambers at that side of the housing to which the opening is open, and positioning projections for being inserted respectively into the positioning recesses are formed in the cover.

In the fourth aspect of the present invention, in addition to the effects of the first to third aspects of the present invention, the positioning projections of the cover are inserted respectively into the positioning recesses of the housing in the completely-retained condition, thereby limiting the forward and backward movement of the cover.

In the connector of a fifth aspect of the present invention, a groove is formed in that portion of each of the partition walls disposed immediately adjacent to a front end of the positioning recess at that side of the housing to which the opening is open, and projections for being respectively inserted into the grooves are formed at a front end of the cover.

In the fifth aspect of the present invention, in addition to the effects of the first to fourth aspects of the present invention, in the completely-retained condition, the projections of the cover are inserted respectively into the grooves of the housing, thereby preventing the front end of the cover from being raised.

DESCRIPTION OF THE PREFERRED EMBODIMENT OF THE INVENTION

Figure 1:
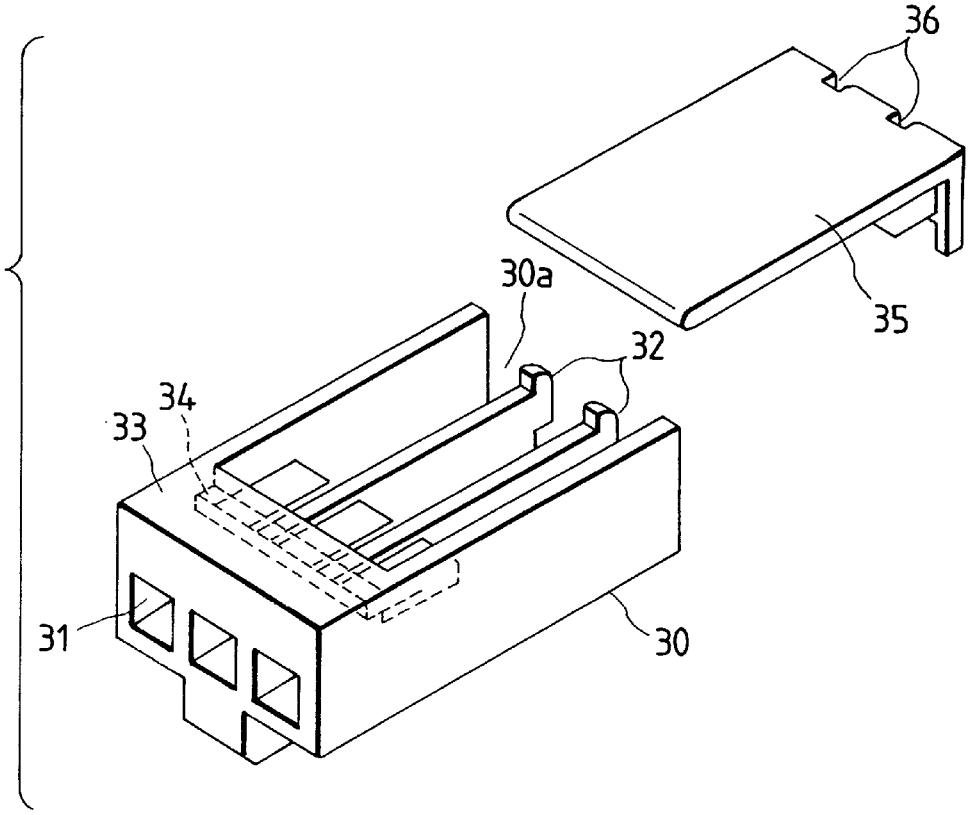
PRIOR ART FIG. 1
FIG. 1 is a perspective view showing a conventional press-connecting terminal connector.
Figure 2:
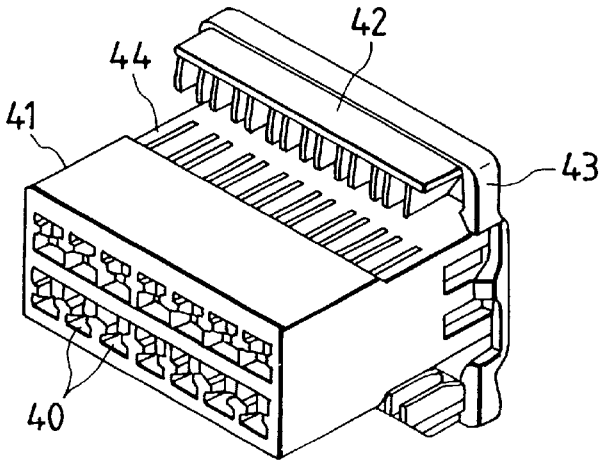
PRIOR ART FIG. 2
FIG. 2 is a perspective view showing a conventional crimp-type terminal connector.

One preferred embodiment of the present invention will now be described in detail with reference to the drawings.

FIGS. 3 to 9 show one preferred embodiment of the invention, and in these Figures, a housing 1 has an opening 1*a* at each of upper and lower sides of a rear half portion thereof, and the housing 1 has two (upper and lower) rows of juxtaposed terminal receiving chambers 2 each having an elastic lance 2*b* formed therein, the two rows of terminal receiving chambers 2 being arranged in inverted relation to each other. Positioning recesses 4 are formed respectively in upper and lower edges of right and left (opposite) side walls 3A and upper and lower edges of a pair of intermediate partition walls 3B, these partition walls being provided for the terminal receiving chambers 2. A crimp-type terminal 26 (shown in FIG. 4) or a press-connecting terminal 27 (shown in FIG. 7) can be mounted in each terminal receiving chamber 2 through the opening 1*a*.

A pair of upper and lower covers 7 are provided for respectively covering the upper and lower openings 1*a* in the housing 1, and each cover 7 is integrally connected by molding to a rear end or edge of a front side wall 6, extending forwardly from the opening 1*a,* through right and left hinges 8 so that the cover 7 can be turned between a closed and an open position. A connecting piece 9, which can be cut, integrally connects the housing 1 to the cover 7 inverted in adjoining relation to the outer surface of the front side wall 6. Projections 10 are formed on a front end of the cover 7, and are fitted respectively in grooves 5, formed in the housing 1, when the cover 7 is closed after cutting the connecting piece 9. Positioning projections 11 are formed on a lower surface (inner surface) of the cover 7, and are fitted respectively in the positioning recesses 4, formed in the housing 1, when the cover 7 is closed.

Engagement means 12 is provided on the housing 1 and each cover 7 and with this engagement means 12, when the cover 7 is closed, the cover 7 can be retained relative to the housing 1 in a two-stage manner, that is, in a provisionally-retained condition in which retaining grooves 13 in the cover 7 are engaged respectively with provisionally-retaining lock portions 14 on the housing 1 and a completely-retained condition in which the retaining grooves 12 in the cover 7 are engaged respectively with completely-retaining lock portions 15 on the housing 1.

Figure 5:
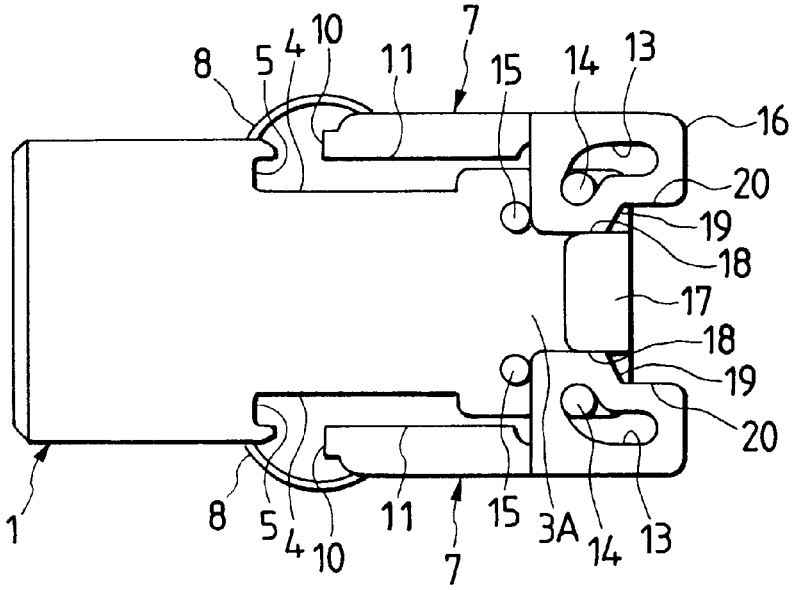
FIG. 5 is a side-elevational view showing a provisionally-retained condition in the above embodiment.
Figure 6:
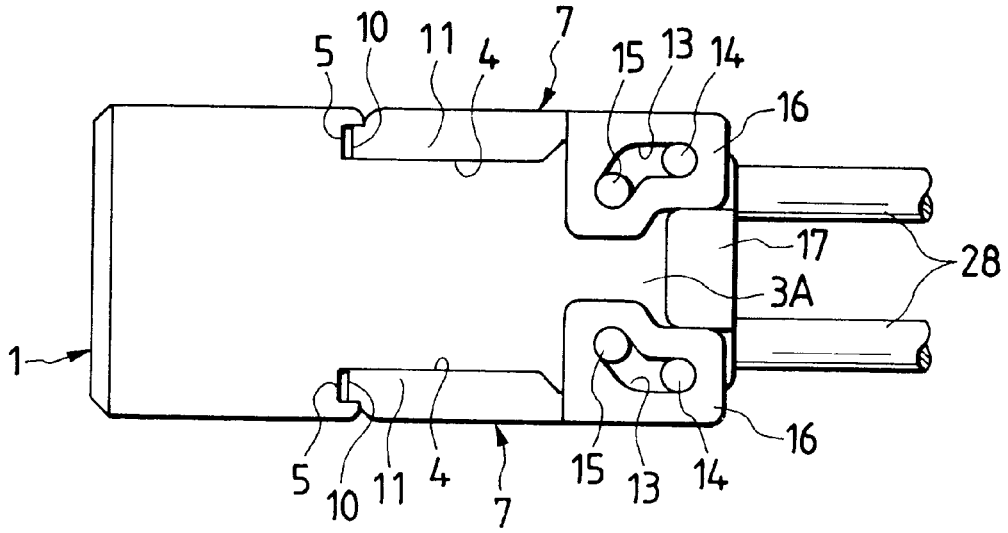
FIG. 6 is a side-elevational view showing a completely-retained condition in the above embodiment.
Figure 9:
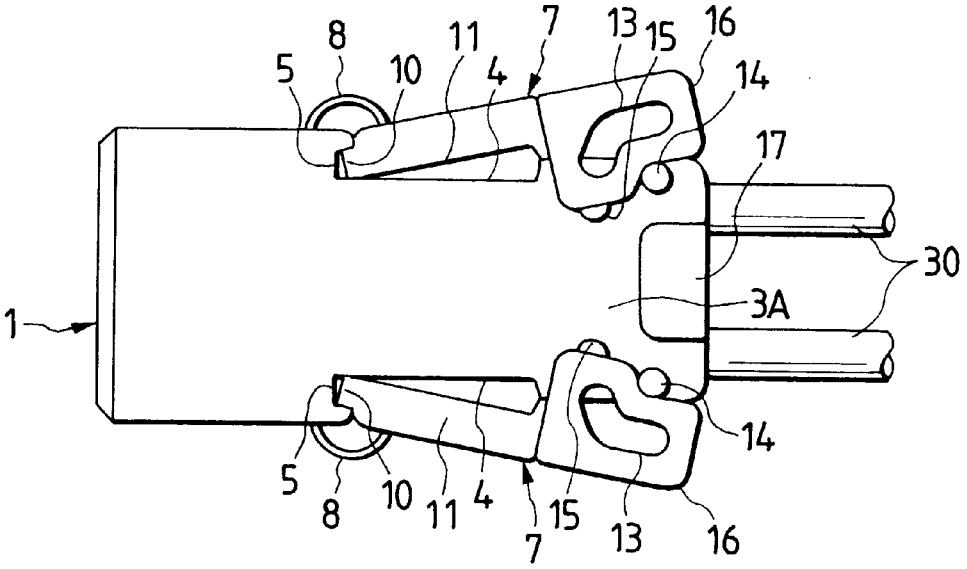
FIG. 9 is a side-elevational view showing a condition in which a cover of the connector is shifted from the provisionally-retained condition to the completely-retained condition.

In this embodiment, as shown in FIGS. 5, 6 and 9, the retaining grooves 13 are, for example, formed respectively in four retaining piece portions 16 (formed on and project from the rear end portion of the cover 7) which are opposed respectively to the right and left side walls 3A and the intermediate partition walls 3B of the housing 1 when the cover 7 is closed.

The provisionally-retaining lock portions 14 are respectively formed on and projected from the right and left side walls 3A and the intermediate partition walls 3B of the housing 1, and each provisionally-retaining lock portion 14 engages a front end of the associated retaining groove 13 when the cover 7 closes the opening 1*a* of the housing 1 in a provisionally-retained condition as shown in FIG. 5, and the provisionally-retaining lock portion 14 moves to a rear end of the retaining groove 13 along the retaining groove 13 when the cover 7 closes the opening 1*a* of the housing 1 in a completely-retained condition as shown in FIG. 6.

The completely-retaining lock portions 15 are respectively formed on and project from the right and left side walls 3A and the intermediate partition walls 3B of the housing 1, and each completely-retaining lock portion 15 is disposed forwardly of the associated retaining piece portion 16 to function as a stopper for limiting the forward movement of the cover 7 when the cover 7 closes the opening 1*a* of the housing 1 in the provisionally-retained condition as shown in FIG. 5, and the completely-retaining lock portion 15 engages the front end of the associated retaining groove 13 when the cover 7 closes the opening 1*a* of the housing 1 in the completely-retained condition as shown in FIG. 6.

The retaining piece portions 16 of the cover 7 have their respective front portions 18 which respectively engage guide projections 17, formed respectively on the right and left side walls 3A, when the cover 7 closes the opening 1*a* of the housing 1 in the provisionally-retained condition as shown in FIG. 5. Also, the retaining piece portion 16 has a step portion 19, which slides over the guide projection 17 when the cover 7 is shifted from the provisionally-retained condition to the completely-retained condition in which the cover 7 completely closes the opening 1*a* of the housing 1, and a rear portion 20 which engages the guide projection 17 of the housing 1 when the cover 7 closes the opening 1*a* of the housing 1 in the completely-retained condition as shown in FIG. 6. An inclined portion 16*a* for slidingly guiding the retaining piece portion 16 over the lock portion 14, 15 is formed on the edge of each retaining piece portion 16.

An elastic lock arm 22 is provided between the intermediate partition walls 3B of the housing 1, and has a projection 21 which is elastically locked into an engagement hole in a mating female connector (not shown) when this mating female connector is connected to the connector of this embodiment. When the cover 7 is held in the completely-retained condition to close the opening 1*a,* this elastic lock arm 22 is exposed forwardly of a bridge portion 23 extending between the two retaining piece portions 16 provided at a central portion of the cover 7.

Lock portions 25 are formed respectively on upper edges of partition walls 2*a* for the plurality of terminal receiving chambers 2 provided between the right and left side walls 3A and the intermediate partition walls 3B, and these lock portions 25 respectively engage engagement portions 24, formed on the cover 7, when the cover 7 is closed in the completely-retained condition.

Figure 3:
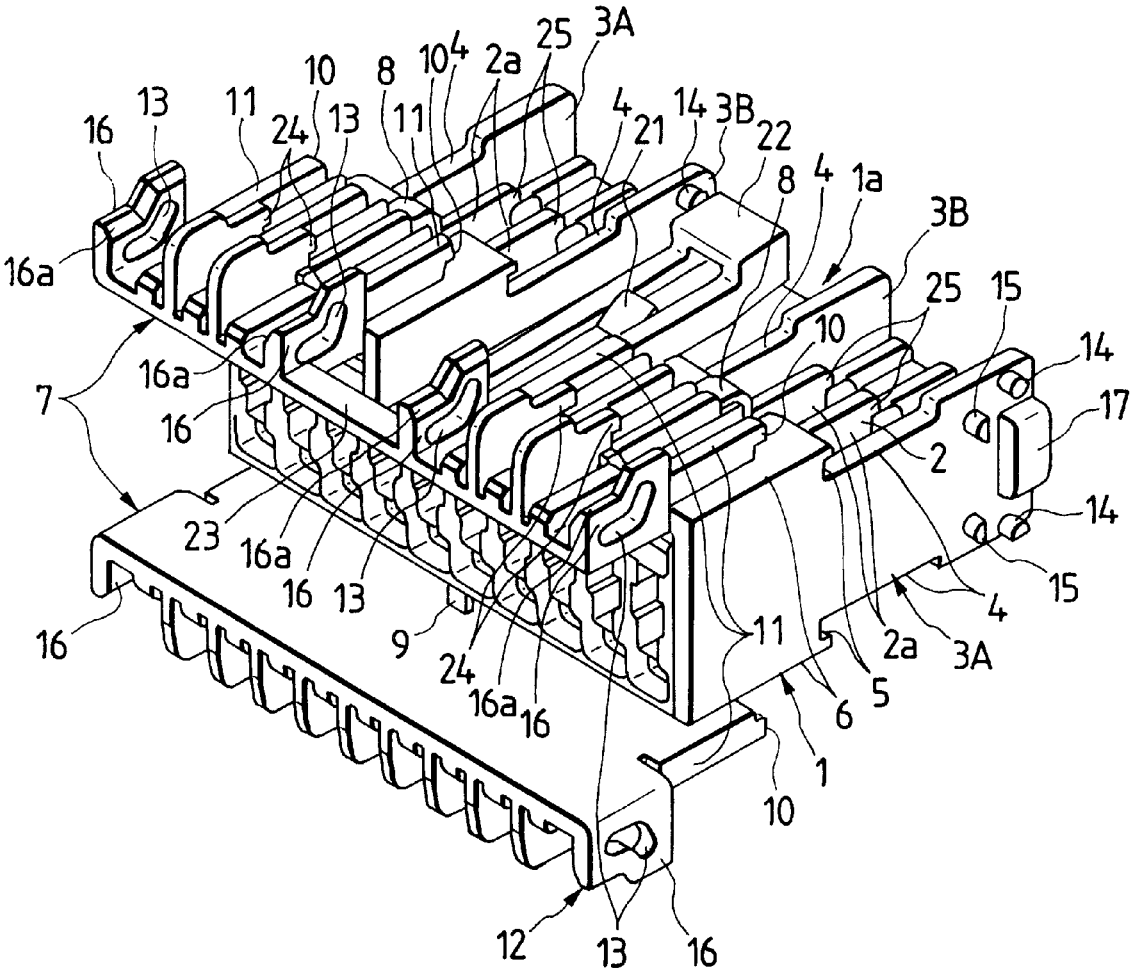
FIG. 3 is a perspective view of one preferred embodiment of a connector of the present invention.
Figure 4:
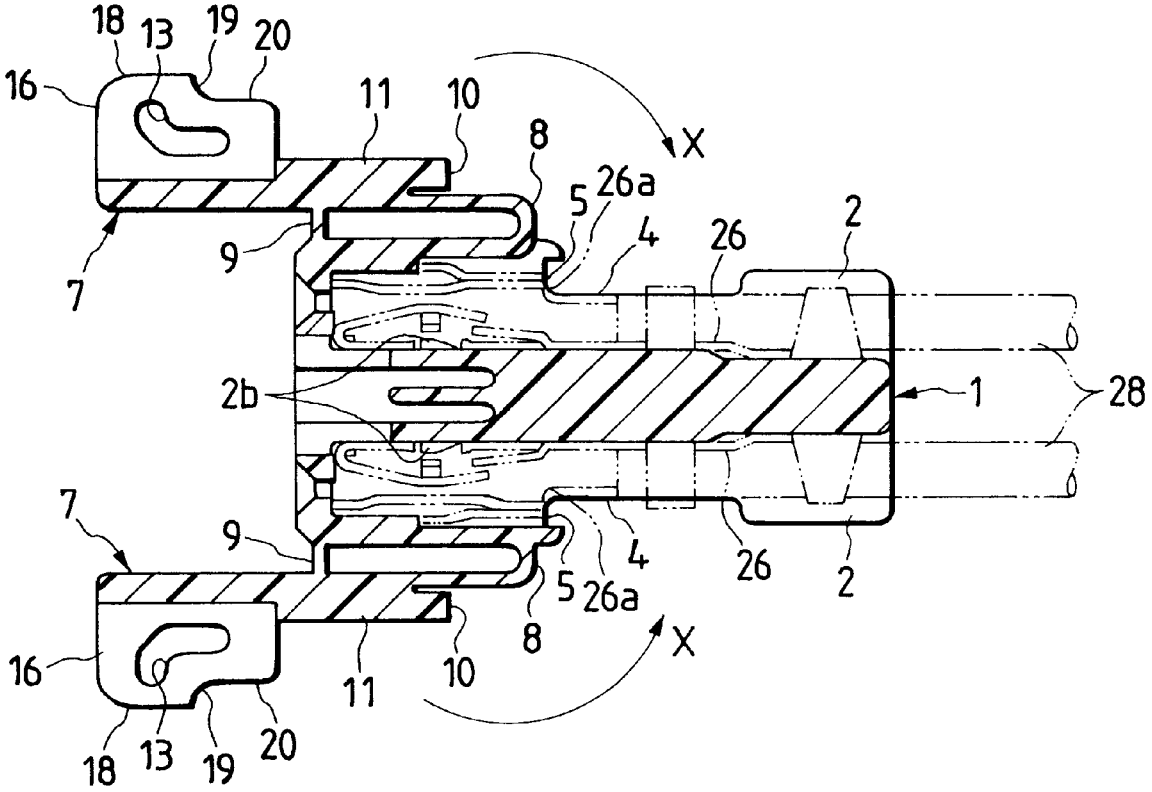
FIG. 4 is a cross-sectional view showing a condition in which crimp-type terminals are mounted in the connector.

In the above construction of this embodiment, as shown in FIG. 3, the connector is resin-molded into an integral construction in which the housing 1 and the upper and lower covers 7 are integrally connected together through the right and left hinges 8 and the central connecting pieces 9.

The crimp-type terminals 26 (shown in phantom in FIG. 4) each connected to a wire 28 can be inserted into the respective terminal receiving chambers 2 through the opening 1*a* of the housing 1. In each terminal receiving chamber 2, the elastic lance 2*b* retains the crimp-type terminal 26. When the connector is thus used for the crimp-type terminals 26, the connecting pieces 9 are cut, and each cover 7 is turned or inverted in a direction of arrow X into the provisionally-retained condition.

More specifically, as shown in FIG. 5, each provisionally-retaining lock portion 14 of the housing 1 is engaged in the associated retaining groove 13 of the cover 7, and also each completely-retaining lock portion 15 of the housing 1 limits the forward movement of the associated retaining piece portion 16 of the cover 7, and the front portion 18 of the retaining piece portion 16 of the cover 7 abuts against the guide projection 17 of the housing 1, thereby holding the cover 7 in the provisionally-retained condition.

Then, as shown in FIG. 6, when the cover 7 is pushed forward, the projections 10 of the cover 7 are inserted respectively into the grooves S through the respective positioning recesses 4 of the housing 1, and also the positioning projections 11 of the cover 7 are fitted respectively into the positioning recesses 4 of the housing 1, and at the same time the retaining piece portions 16 of the cover 7 move along the respective guide projections 17 of the housing 1, and the front portion 18 and the step portion 19 of the retaining piece portion 16 pass past the guide projection 17, and then the rear portion 20 abuts against the guide projection 17, and at the same time each provisionally-retaining lock portion 14 of the housing 1 moves along the associated retaining groove 13 of the cover 7, and each completely-retaining lock portion 15 is fitted into the associated retaining groove 13, thereby retaining the cover 7 on the housing 1 in the completely-retained condition. In the completely-retained condition, the projections 10 of the cover 7 are engaged respectively with shoulders 26*a* of the terminals 26, thus achieving a double retaining effect. Thereafter, the right and left hinges 8 are cut.

The connector is thus used for the crimp-type terminals 26, and in this case, each time the crimp-type terminals 26, connected to the wire 28, are mounted in the corresponding terminal receiving chambers 2, the cover 7 is provisionally retained on the housing 1 to cover the rear portions of the terminals 26 to thereby prevent the withdrawal of the terminals. Then, when the crimp-typo terminals 26 are mounted respectively in all of the terminal receiving chambers 2, the cover 7 is positively retained on the housing 1 in the completely-retained condition. In the provisionally-retained condition of the cover 7, the completely-retaining lock portions 15 limit the forward movement of the cover 7, thereby suitably maintaining the provisionally-retained condition.

Figure 7:
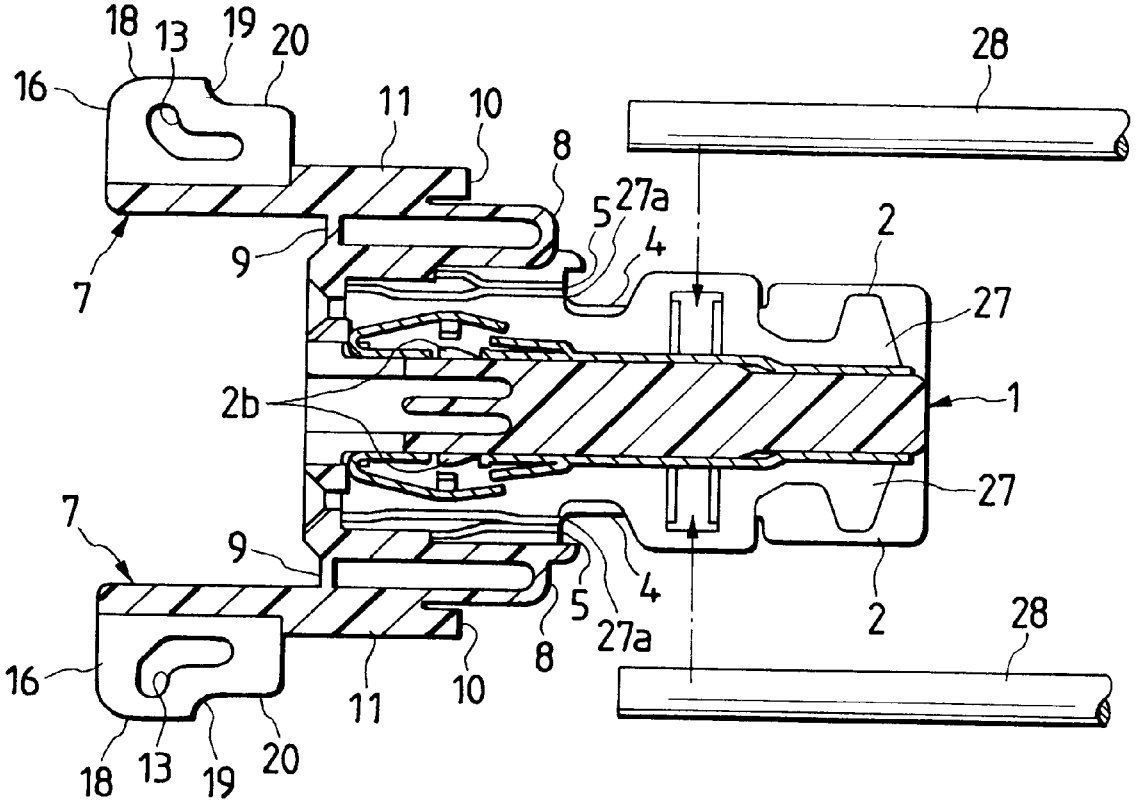
FIG. 7 is a cross-sectional view showing a condition in which press-connecting terminals are mounted in the connector.

On the other hand, when the connector is used for the press-connecting terminals 27, the press-connecting terminals 27 are first inserted respectively into the terminal receiving chambers 2 through the openings 1*a* of the housing 1 as shown in FIG. 7.

Figure 8:
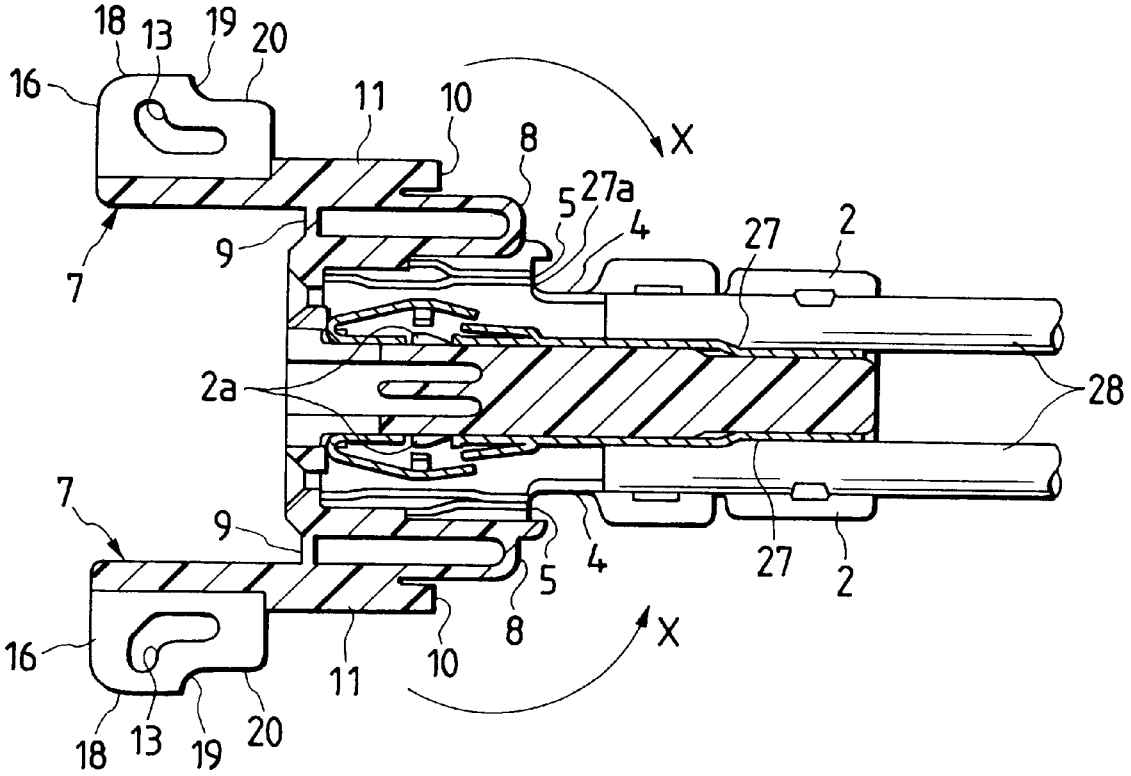
FIG. 8 is a cross-sectional view showing a condition in which wires are press-connected to the press-connecting terminals in the above embodiment.

Then, as shown in FIG. 8, the wires 28 are press-connected respectively to the press-connecting terminals 27, and then the connecting pieces 9 are cut, and the covers 7 are turned or inverted in the directions of arrows X.

Then, as shown in FIG. 9, the projections 10 of the cover 7 are fitted respectively into the grooves 5 of the housing 1, and each cover 7 is pushed in the closing direction.

As a result, as shown in FIG. 6, the positioning projections 11 of the cover 7 are fitted respectively into the positioning recesses 4 of the housing 1, and also the provisionally-retaining lock portions 14 of the housing 1, as well as the completely-retaining lock portions 15, are fitted respectively in the retaining grooves 13 of the cover 7, thereby completely retaining the cover 7 relative to the housing 1. In this completely-retained condition, the projections 10 of the cover 7 abut respectively against shoulders 27*a* of the terminals 27, thus achieving a double lock effect as in the above case. Thereafter, the right and left hinges 8 are cut.

When the connector is thus used for the press-connecting terminals 27, the wires 28 are press-connected respectively to the press-connecting terminals 27 mounted respectively in all of the terminal receiving chambers 2, and then the cover 7 is positively retained directly on the housing 1 in the completely-retained condition.

The following effects are achieved by the present invention.

In the first aspect of the present invention, when the crimp-type terminals each connected to the wire are to be inserted, the two-stage retaining operation (that is, the provisionally-retained condition and the completely-retained condition) can be used, and also when the wires are to be press-connected respectively to the press-connecting terminals, beforehand mounted in the housing, through the opening, the one-stage retaining operation can be used. Thus, the connector can be used for either of the crimp-type terminals and the press-connecting terminals, and the efficiency of the operation is enhanced, and the cost can be reduced.

In the second aspect of the invention, in addition to the effects of the first aspect, the completely-retaining lock portions limit the forward movement of the cover in the provisionally-retained condition, thereby enhancing the efficiency of mounting of the crimp-type terminals.

In the third aspect of the invention, in addition to the effects of the first and second aspect, the cover, inverted on the front portion of the housing, is held on the housing by the connecting piece, and therefore the operation efficiency for the press-connecting terminals is enhanced.

In the fourth aspect of the invention, in addition to the effects of the first to third aspects of the invention, the positioning projections of the cover are fitted respectively in the positioning recesses of the housing in the completely-retained condition, thereby limiting the forward and backward movement of the cover, thus positively effecting the double lock of the terminals.

In the fifth aspect of the invention, in addition to the effects of the first to fourth, in the completely-retained condition, the projections of the cover are fitted respectively in the grooves of the housing, thereby preventing the front end of the cover from being raised, thus positively effecting the double lock of the terminals.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A connector comprising:

a housing having an opening formed at one side of rear half portions of terminal receiving chambers into which wires are respectively insertable through said opening;

a cover turnable between an open position where said cover is disposed forwardly of said opening toward front half portions of said terminal receiving chambers and a closed position where said opening is covered by said cover; and a hinge for integrally connecting said housing and said cover at a position disposed forwardly of said opening and for making said cover turnable relative to said housing;

an engagement means for retaining said cover relative to said housing in a two-stage manner, one stage of which is a provisionally-retained condition where said cover is provisionally retained relative to said housing while terminals are provisionally retained and respectively received in said terminal receiving chambers, and another stage of which is a completely-retained condition where said cover is completely retained relative to said housing so as to completely retain said terminals and also to close said opening;

a connecting piece formed integrally with said housing and said cover for temporarily connecting said housing to said cover in said closed position, wherein said connecting piece is severed when said cover is turned from said closed position to said open position through said hinge;

positioning recesses being formed respectively in partition walls for defining said terminal receiving chambers at that side of said housing to which said opening is open, and positioning projections for being inserted respectively into said positioning recesses are formed in said cover;

a groove being formed in that portion of each of said partition walls disposed immediately adjacent to a front end of said positioning recess at that side of said housing to which said opening is open; and projections for being respectively inserted into said grooves being formed at a front end of said cover.

2. A connector comprising:

a housing having an opening formed at one side of rear half portions of terminal receiving chambers into which wires are respectively insertable through said opening;

a cover turnable between an open position where said cover is disposed forwardly of said opening toward front half portions of said terminal receiving chambers and a closed position where said opening is covered by said cover; and a hinge for integrally connecting said housing and said cover at a position disposed forwardly of said opening and for making said cover turnable relative to said housing;

an engagement means for retaining said cover relative to said housing in a two-stage manner, one stage of which is a provisionally-retained condition where said cover is provisionally retained relative to said housing while terminals are provisionally retained and respectively received in said terminal receiving chambers, and another stage of which is a completely-retained condition where said cover is completely retained relative to said housing so as to completely retain said terminals and also to close said opening;

said engagement means including retaining grooves formed in said cover, provisionally-retaining lock portions formed on said housing, and completely-retaining lock portions formed on said housing, wherein in said provisionally-retained condition said provisionally-retaining lock portions are engaged respectively in said retaining grooves while said completely-retaining lock portions function as stoppers for said cover;

a connecting piece formed integrally with said housing and said cover for temporarily connecting said housing to said cover in said closed position, wherein said connecting piece is severed when said cover is turned from said closed position to said opened position through said hinge;

positioning recesses being formed respectively in partition walls for defining said terminal receiving chambers at that side of said housing to which said opening is open, and positioning projections for being inserted respectively into said positioning recesses are formed in said cover;

a groove being formed in that portion of each of said partition walls disposed immediately adjacent to a front end of said positioning recess at that side of said housing to which said opening is open, and projections for being respectively inserted into said grooves being formed at a front end of said cover.

* * * * *